US011692374B2

(12) United States Patent
Chen et al.

(10) Patent No.: US 11,692,374 B2
(45) Date of Patent: Jul. 4, 2023

(54) LOCK MECHANISM FOR OBJECTS MOVABLE RELATIVE TO EACH OTHER

(71) Applicants: King Slide Works Co., Ltd., Kaohsiung (TW); King Slide Technology Co., Ltd., Kaohsiung (TW)

(72) Inventors: Ken-Ching Chen, Kaohsiung (TW); Chun-Ta Liu, Kaohsiung (TW); Hsin-Cheng Su, Kaohsiung (TW); Chih-Te Chuang, Kaohsiung (TW); Shu-Chen Lin, Kaohsiung (TW)

(73) Assignees: King Slide Works Co., Ltd., Kaohsiung (TW); King Slide Technology Co., Ltd., Kaohsiung (TW)

( * ) Notice: Subject to any disclaimer, the term of this patent is extended or adjusted under 35 U.S.C. 154(b) by 1033 days.

(21) Appl. No.: 16/137,866

(22) Filed: Sep. 21, 2018

(65) Prior Publication Data

US 2020/0018098 A1 Jan. 16, 2020

(30) Foreign Application Priority Data

Jul. 10, 2018 (TW) ..... 107124185

(51) Int. Cl.
*E05B 65/462* (2017.01)
*E05B 65/52* (2006.01)
(Continued)

(52) U.S. Cl.
CPC ..... *E05B 65/462* (2013.01); *E05B 65/5215* (2013.01); *E05B 47/0001* (2013.01); *E05B 47/06* (2013.01); *E05C 3/12* (2013.01)

(58) Field of Classification Search
CPC ..... E05B 65/462; E05B 65/46; E05B 65/005; E05B 47/001; E05B 47/06;
(Continued)

(56) References Cited

U.S. PATENT DOCUMENTS 6,116,067 A * 9/2000 Myers ..... B25H 3/028 70/279.1
7,331,643 B2 2/2008 Huber
(Continued)

FOREIGN PATENT DOCUMENTS

EP 1703045 A1 9/2006
EP 2998487 A2 3/2016
(Continued)

*Primary Examiner* — Christine M Mills
*Assistant Examiner* — Yahya Sidky
(74) *Attorney, Agent, or Firm* — Alan D. Kamrath; Karin L. Williams; Mayer & Williams PC

(57) ABSTRACT

A lock mechanism is configured to be arranged on one of a first object and a second object movable relative to each other. The lock mechanism includes a driving device and a locking member. The locking member is configured to be driven by the driving device to move between a first position and a second position in a non-rotatable manner. When the locking member is located at the first position, the locking member is configured to lock the other one of the first object and the second object. When the locking member is located at the second position, the locking member is does not lock the other one of the first object and the second object.

6 Claims, 13 Drawing Sheets

(51) Int. Cl.
*E05B 47/00* (2006.01)
*E05B 47/06* (2006.01)
*E05C 3/12* (2006.01)

(58) Field of Classification Search
CPC .. E05B 64/5215; E05C 3/12; Y10T 292/1021; Y10T 292/096; Y10T 292/1014; Y10T 292/0969
See application file for complete search history.

(56) References Cited

U.S. PATENT DOCUMENTS

| | | | | |
|---|---|---|---|---|
| 7,570,172 | B2 | 8/2009 | Kamiki | |
| 8,328,299 | B2 | 12/2012 | Hashemi et al. | |
| 8,494,680 | B2 * | 7/2013 | Sparenberg | F16P 7/00 700/275 |
| 9,295,331 | B2 | 3/2016 | Slogoff | |
| 9,725,924 | B2 | 8/2017 | Hashemi et al. | |
| 9,801,468 | B2 | 10/2017 | Hashemi et al. | |
| 2002/0105200 | A1 * | 8/2002 | Reynolds | E05B 47/026 296/3 |
| 2010/0218569 | A1 * | 9/2010 | Hunt | E05C 19/166 70/263 |
| 2015/0184426 | A1 * | 7/2015 | Arlinghaus | E05B 15/004 292/138 |
| 2017/0347794 | A1 | 12/2017 | McGregor et al. | |
| 2020/0270903 | A1 | 8/2020 | Stein et al. | |

FOREIGN PATENT DOCUMENTS

| | | | |
|---|---|---|---|
| WO | WO2004101919 | A1 | 11/2004 |
| WO | WO2017142908 | A1 | 8/2017 |

* cited by examiner

LOCK MECHANISM FOR OBJECTS MOVABLE RELATIVE TO EACH OTHER

BACKGROUND OF THE INVENTION

1. Field of the Invention

The present invention relates to a lock mechanism, and more particularly, to a lock mechanism applicable to objects movable relative to each other.

2. Description of the Prior Art

Generally, a slide rail assembly can be used in a rack system for home, office or electronic device. The slide rail assembly comprises a first rail and a second rail respectively mounted to a first object and a second object, such as a cabinet and a drawer, such that the drawer can be opened or retracted relative to the first rail and/or the cabinet through the second rail.

For different market requirements, a user may not want the second rail (the second object) to be freely operated relative to the first rail (the first object) to move away from a predetermined position. U.S. Pat. No. 8,328,299 B2 discloses a drawer slide and a lock mechanism. The lock mechanism (104) is an electronic lock. As shown in FIG. 1 of the aforementioned application, the drawer slide comprises an outer slide member (106) and an inner slide member (108). The inner slide member (108) can be located at a closed position relative to the outer slide member (106). Wherein, a rear end of the inner slide member (108) is provided with a pin (116). On the other hand, the lock mechanism (104) comprises a latch receiver (115), a lever arm (117) and a motor (119). Wherein, as shown in FIG. 1 and FIG. 2 of the application, the latch receiver (115, 218) can be located at a first position. When the latch receiver (115, 218) is located at the first position, the latch receiver (115, 218) is configured to capture the pin (116, 216) of the inner slide member (108). As shown in FIG. 3 of the application, when the motor (119, 240, 328) receives an electronic control signal, the motor (328) is configured to drive the lever arm (304) to rotate, such that a top edge (308) of the lever arm (304) can be driven to push the latch receiver (324) to rotate from the first position to a second position in order to lock the pin (316) of the inner slide member (322). According to such configuration, the inner slide member (322) can be locked at the closed position relative to the outer slide member.

Furthermore, the latch receiver (324) and the lever arm (304) are configured to rotate to work with each other, and a first spring (326) and a second spring (350) are respectively required to apply spring forces to the lock mechanism for locking or unlocking. However, for different market requirements or different structural operations, such configuration may not be proper to achieve some locking functions. Therefore, it is important to develop a product with a simple structure to lock a movable object relative to a fixed object in a different way.

SUMMARY OF THE INVENTION

The present invention relates to a lock mechanism which is applicable to objects movable relative to each other.

According to an embodiment of the present invention, a lock mechanism is applicable to a first object and a second object movable relative to each other. The lock mechanism is configured to be mounted on the first object or the second object. The lock mechanism comprises a driving device and a locking member. The locking member is configured to be driven by the driving device to linearly move between a first position and a second position. Wherein, when the locking member is located at the first position, the locking member is configured to lock the other one of the first object and the second object. Wherein, when the locking member is located at the second position, the locking member does not lock the other one of the first object and the second object.

Preferably, the lock mechanism further comprises an elastic member configured to provide an elastic force to the locking member.

Preferably, the driving device comprises a motor. The lock mechanism further comprises a linkage member connected to the locking member. The linkage member is configured to be linearly moved in response to a rotational driving force of the motor.

Preferably, the lock mechanism further comprises a driving member connected to a shaft of the motor. The linkage member is configured to be driven by the driving member.

Preferably, a linear moving direction of the linkage member is substantially perpendicular to an axial direction of the shaft.

Preferably, the lock mechanism further comprises a housing. The linkage member and the housing have corresponding structural features interacting with each other for guiding the linkage member to linearly move relative to the housing.

Preferably, the lock mechanism further comprises a manual releasing feature arranged on one of the linkage member and the locking member. When the linkage member does not move in response to the rotational driving force of the motor, the manual releasing feature is configured to drive the locking member to move from the first position to the second position.

Preferably, the lock mechanism is detachably connected to one of the first object and the second object through the housing.

Preferably, the lock mechanism further comprises a fixing base. The locking member comprises a contact part. The elastic member is arranged between the fixing base and the contact part.

Preferably, the lock mechanism further comprises a sensor configured to detect whether the second object is located at a predetermined position relative to the first object.

According to another embodiment of the present invention, a lock mechanism is applicable to a first object and a second object. The lock mechanism is configured to be mounted on one of the first object and the second object. The lock mechanism comprises a driving device and a locking member. The locking member is configured to be driven by the driving device to move between a first position and a second position in a non-rotatable manner. Wherein, when the locking member is located at the first position, the locking member is configured to lock the other one of the first object and the second object for preventing the second object from moving relative to the first object. Wherein, when the locking member is located at the second position, the locking member does not lock the other one of the first object and the second object for allowing the second object to move relative to the first object.

Preferably, the first object and the second object are respectively a first rail and a second rail of a slide rail assembly; or the first object and the second object are respectively a cabinet and a movable member.

According to another embodiment of the present invention, a lock mechanism comprises a driving device, a driving member, a locking member, a linkage member and an elastic member. The driving device comprises a motor. The driving member is connected to a shaft of the motor. The linkage member is connected to the locking member. The elastic member is configured to provide an elastic force to one of the linkage member and the locking member for holding the locking member at a locking position. Wherein, the driving member is configured to drive the linkage through a rotational driving force provided by a shaft of the motor, in order to linearly move the locking member away from the locking position.

These and other objectives of the present invention will no doubt become obvious to those of ordinary skill in the art after reading the following detailed description of the preferred embodiment that, is illustrated in the various figures and drawings.

DETAILED DESCRIPTION

Figure 1:
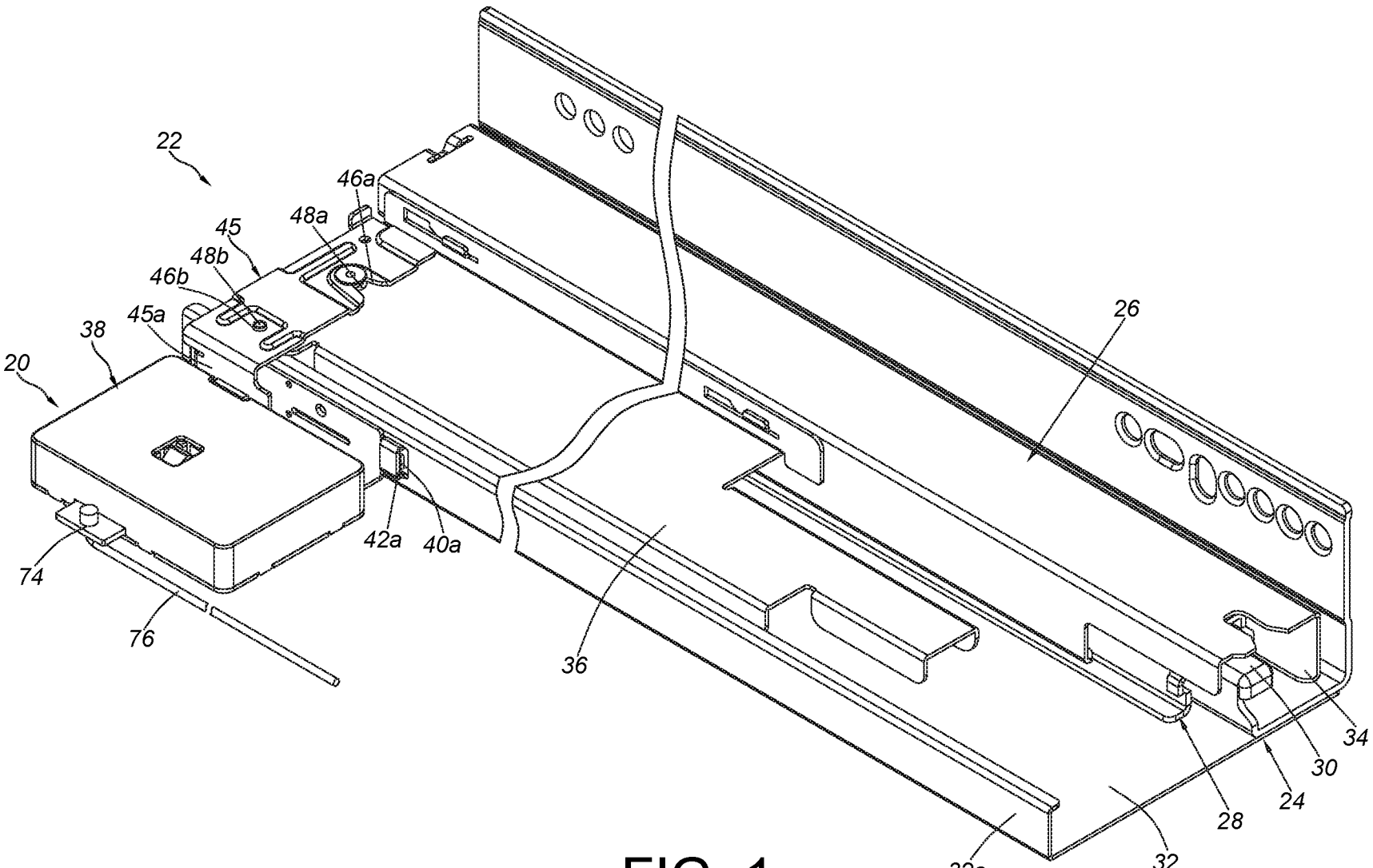
FIG. 1 is a diagram showing a lock mechanism applicable to a slide rail assembly according to a first embodiment of the present invention.
Figure 2:
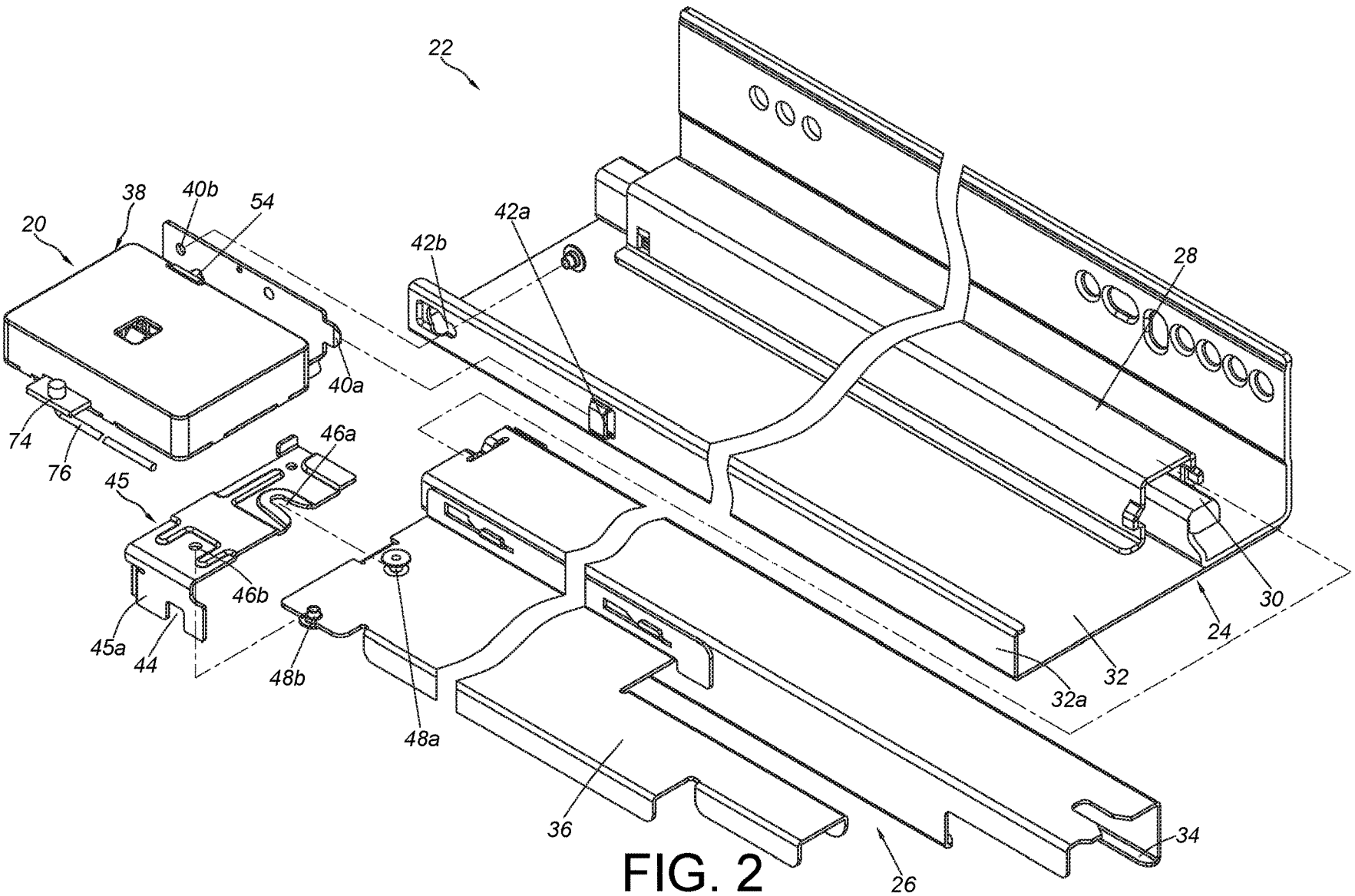
FIG. 2 is a diagram showing an exploded view of the lock mechanism and the slide rail assembly according to the first embodiment of the present invention.

As shown in FIG. 1 and FIG. 2, a lock mechanism 20 is applicable to a first object and a second object movable relative to each other according to a first embodiment of the present invention. In the present embodiment, the first object and the second object are respectively a first rail 24 and a second rail 26 of a slide rail assembly 22. The second rail 26 is movable relative to the first rail 24. Preferably, the slide rail assembly 22 further comprises a third rail 28 movably mounted between the first rail 24 and the second rail 26 for extending a traveling distance of the second rail 26 relative to the first rail 24.

Preferably, the first rail 24 comprises a first rail part 30 and a first extension part 32. The first extension part 32 is laterally (transversely) extended relative to a longitudinal direction of the first rail part 30. The third rail 28 is movably mounted to the first rail 24 through the first rail part 30.

Preferably, the second rail 26 comprises a second rail part 34 and a second extension part 36. The second extension part 36 is laterally (transversely) extended relative to a longitudinal direction of the second rail part 34. The second rail 26 is movably mounted to the third rail 28 through the second rail part 34.

Preferably, the lock mechanism 20 is arranged on one of the first rail 24 and the second rail 26. In the present embodiment, the lock mechanism 20 is detachably connected to one of the first rail 24 and the second rail 26. For example, the lock mechanism 20 is detachably connected to the first rail 24. Specifically, the lock mechanism 20 is detachably connected to at least one corresponding feature (such as a first corresponding feature 42*a* and/or a second corresponding feature 42*b*) of a wall 32*a* of the first extension part 32 of the first rail 24 through at least one connecting feature (such as a first connecting feature 40*a* and/or a second connecting feature 40*b*) of a housing 38. Wherein, the at least one connecting feature 40*a*, 40*b* is connected to the at least one corresponding feature 42*a*, 42*b* by engaging, fastening or screwing. But the present invention is not limited thereto.

On the other hand, the other one of the first rail 24 and the second rail 26 is arranged with an additional feature 44. The additional feature 44 is configured to interact with a locking part 54 of the lock mechanism 20. In the present embodiment, the additional feature 44 is provided on an extension wall 45*a* of a fitting member 45. The fitting member 45 is detachably connected to the other one of the first rail 24 and the second rail 26. For example, the fitting member 45 is detachably connected to the second rail 26. Specifically, the fitting member 45 is detachably connected to at least one mounting structure (such as a first mounting structure 48*a* and/or a second mounting structure 48*b*) of the second extension part 36 of the second rail 26 through at least one mounting feature (such as a first mounting feature 46*a* and/or a second mounting feature 46*b*). The at least one mounting feature 46*a*, 46*b* is connected to the at least one mounting structure 48*a*, 48*b* by engaging, fastening or screwing. But the present invention is not limited thereto. Moreover, the additional feature 44 can be directly integrally formed on the second rail 26, but the present invention is not limited thereto.

Figure 3:
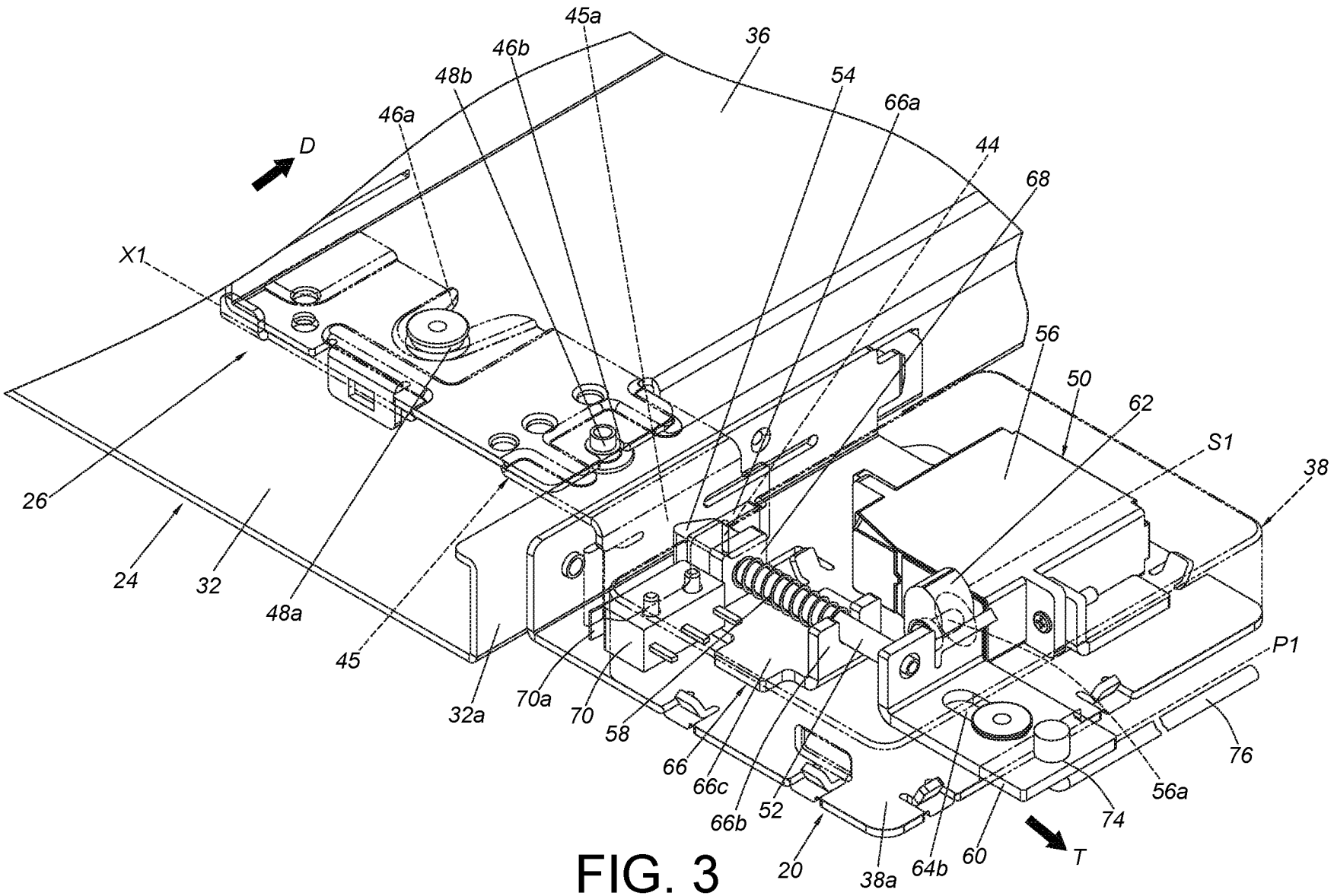
FIG. 3 is a partial view showing the lock mechanism configured to lock a second rail of the slide rail assembly for preventing the second rail from moving away from a first predetermined position relative to a first rail according to the first embodiment of the present invention.
Figure 4:
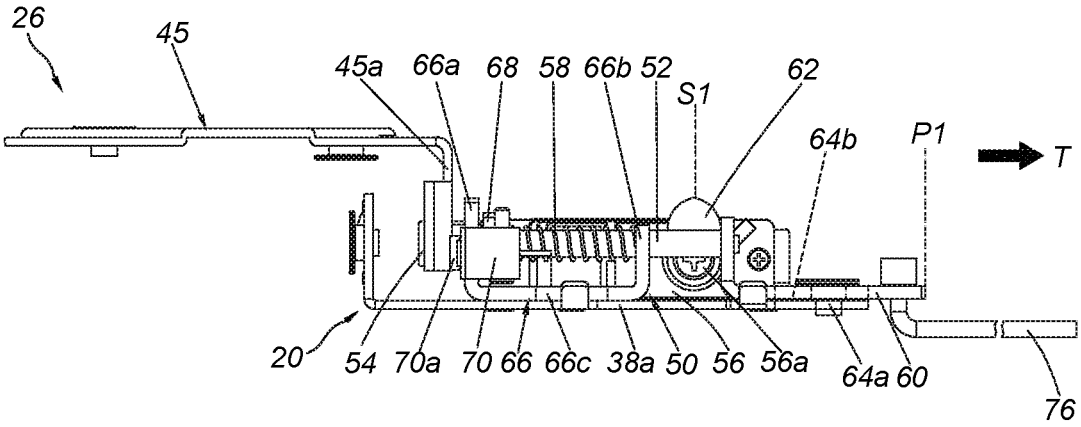
FIG. 4 is a diagram showing the lock mechanism configured to lock a portion of the second rail of the slide rail assembly according to the first embodiment of the present invention.
Figure 5:
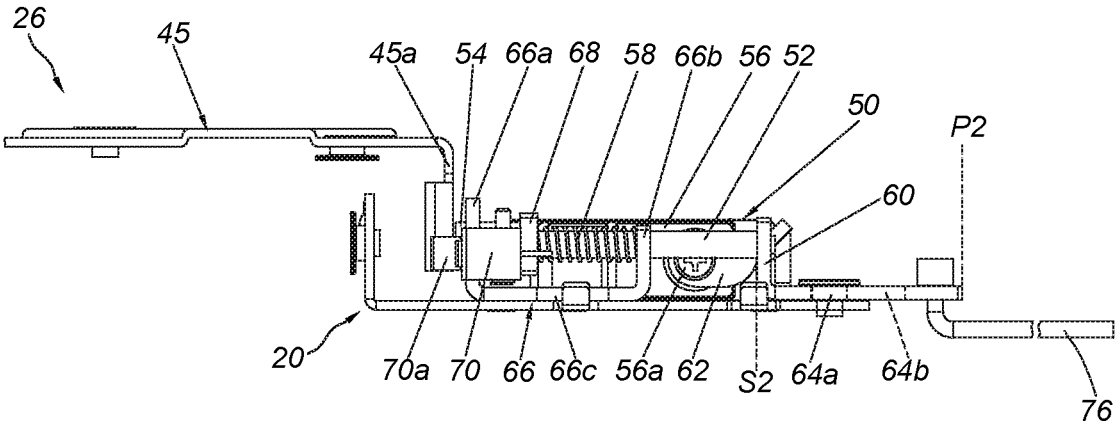
FIG. 5 is a diagram showing the lock mechanism no longer locking the portion of the second rail of the slide rail assembly according to the first embodiment of the present invention.
Figure 6:
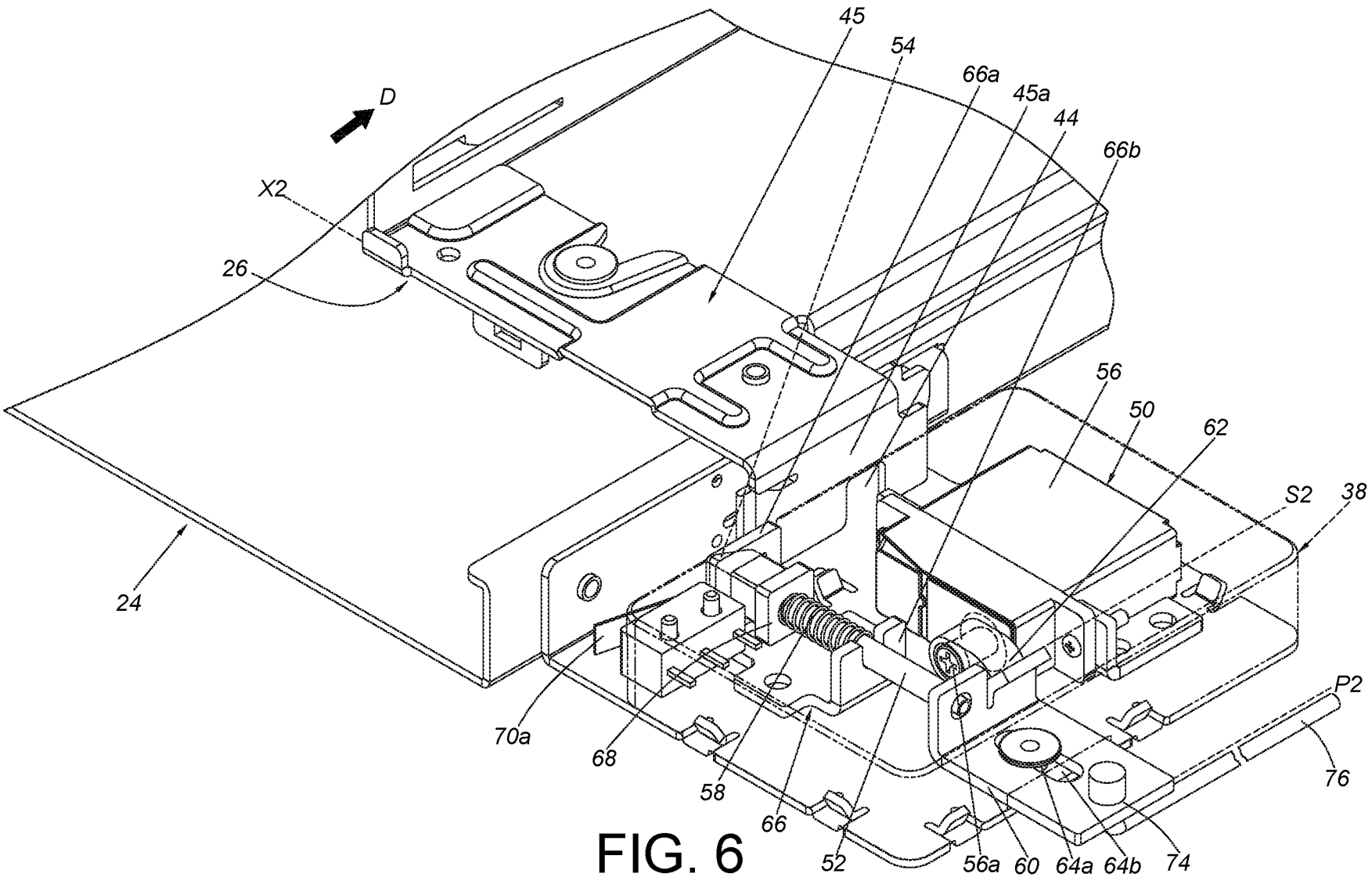
FIG. 6 is a partial view showing the lock mechanism no longer locking the second rail of the slide rail assembly for allowing the second rail to move away from the first predetermined position relative to the first rail according to the first embodiment of the present invention.

As shown in FIG. 3 and FIG. 4, the lock mechanism 20 comprises a driving device 50 and a locking member 52. The locking member 52 comprises the locking part 54 (or a locking bolt). The locking member 52 is configured to be located at one of a first position P1 (as shown in FIG. 3 and FIG. 4) and a second position P2 (as shown in FIG. 5 and FIG. 6).

In FIG. 3 and FIG. 4, when the locking member 52 is located at the first position P1, the locking member 52 is configured to lock the second rail 26 for preventing the second rail 26 from being moved relative to the first rail 24.

Preferably, the driving device 50 comprises a motor 56 (such as a servo motor), and the lock mechanism 20 further comprises an elastic member 58, a linkage member 60 and a driving member 62.

The elastic member 58 is configured to provide an elastic force to the locking member 52. In the present embodiment, the locking member 52 is configured to be held at the first position P1 in response to the elastic force of the elastic member 58, and the first position P1 is a locking position, but the present invention is not limited thereto. Furthermore, when the second rail 26 is located at a first predetermined position X1 (such as a retracted position, but it is not limited thereto) relative to the first rail 24 and the locking member 52 is located at the first position P1, the locking part 54 of the locking member 52 is configured to lock the additional feature 44 (such as a hole or a groove) of the second rail 26. In such state, the second rail 26 is prevented from being moved relative to the first rail 24 from the first predetermined position X1 along a direction D.

The linkage member 60 is connected to the locking member 52. In the present embodiment, the linkage member 60 is fixed to the locking member 52. Therefore, the linkage member 60 and the locking member 52 can be seen as one piece. The linkage member 60 can be linearly moved in response to a rotational driving force of a shaft 56*a* of the motor 56.

The driving member 62 is connected to the shaft 56*a* of the motor 56. The driving member 62 can be a cam or a lever arm. The linkage member 60 is configured to be driven by the driving member 62. Preferably, a linear moving direction of the linkage member 60 is substantially perpendicular to an axial direction of the shaft 56*a*. For example, the linkage member 60 is linearly movable along a transverse direction, and the shaft 56*a* of the motor 56 is arranged along a longitudinal direction (the longitudinal direction is same as a longitudinal direction or a moving direction of the rails). Furthermore, the linkage member 60 and a base 38*a* of the housing 38 have corresponding structural features interacting with each other for guiding the linkage member 60 to linearly move relative to the base 38*a* of the housing 38. The structural features can be a combination of a protrusion 64*a* and an elongated hole 64*b* (or an elongated groove). For example, the protrusion 64*a* is inserted into a portion of the elongated hole 64*b*, and the elongated hole 64*b* (or the elongated groove) has a predetermined boundary, such that the linkage member 60 can be linearly moved relative to the base 38*a* within a limited range.

Preferably, the lock mechanism 20 further comprises a fixing base 66 fixed relative to the housing 38. In the present embodiment, the fixing base 66 comprises a first part 66*a*, a second part 66*b* and a third part 66*c* arranged between the first part 66*a* and the second part 66*b*. Wherein, the third part 66*c* is fixed to the base 38*a* of the housing 38, and the first part 66*a* and the second part 66*b* are substantially perpendicularly connected to the third part 66*c*. Wherein, when the locking member 52 is located at the first position P1, the locking part 54 of the locking member 52 is in an extended state relative to the first part 66*a* of the fixing base 66 and configured to lock the additional feature 44 of the extension wall 45*a* of the fitting member 45. On the other hand, the locking member 52 further comprises a contact part 68. The elastic member 58 is arranged between the second part 66*b* of the fixing base 66 and the contact part 68 of the locking member 52. Preferably, the lock mechanism 20 further comprises a sensor 70 configured to detect whether the second rail 26 is located at the first predetermined position X1. For example, the sensor 70 is a micro switch which comprises an elastic sensing part 70*a*. When the second rail 26 is located at the first predetermined position X1 relative to the first rail 24, a portion of the second rail 26 (such as the extension wall 45*a* of the fitting member 45 of the second rail 26) is configured to press the elastic sensing part 70*a*, such that the elastic sensing part 70*a* is configured to accumulate an elastic force to further generate an electronic sensing signal. Accordingly, the sensor 70 thus detects that the second rail 26 is located at the first predetermined position X1 relative to the first rail 24.

As shown in FIG. 4, FIG. 5 and FIG. 6, the locking member 52 is configured to be driven by the driving device 50 to move from the first position P1 to the second position P2 in a non-rotatable manner. In the present embodiment, the locking member 52 is linearly moved from the first position P1 to the second position P2 along a transverse direction T, and the second position P2 is an unlocking position. Wherein, when the locking member 52 is located at the second position P2, the locking member 52 does not lock the second rail 26, such that the second rail 26 is movable relative to the first rail 24.

Specifically, when the motor 56 of the driving device 50 receives an electronic control signal, the shaft 56*a* of the motor 56 can be controlled to rotate a specific angle, such that the driving member 62 is rotated along a direction (such as a clockwise direction) to be switched from a first state S1 (as shown in FIG. 4) to a second state S2 (as shown in FIG. 5 and FIG. 6), so as to drive the linkage member 60 and the locking member 52 to move from the first position P1 to the second position P2. As such, the locking part 54 of the locking member 52 is in a retracted state relative to the first part 66*a* of the fixing base 66 without locking the additional feature 44 of the extension wall 45*a* of the fitting member 45. In such sate, the second rail 26 can be moved relative to the first rail 24 from the first predetermined position X1 to a second predetermined position X2 (such as an extension position shown in FIG. 6) along the direction D. Wherein, when the locking member 52 is located at the second position P2, the elastic member 58 is pressed between the second part 66*b* of the fixing base 66 and the contact part 68 of the locking member 52, such that the elastic member 58 is in a state of accumulating an elastic force.

Therefore, the driving device 50 can receive an electronic control signal transmitted from an electronic device (such as a computer, a mobile phone or a wireless sensor) to control the locking member 52 to no longer lock the second rail 26. Moreover, when the second rail 26 is moved relative to the first rail 24 from the first predetermined position X1 to the second predetermined position X2 along the direction D, the extension wall 45*a* of the fitting member 45 of the second rail 26 no longer presses the elastic sensing part 70*a*, such that the elastic sensing part 70*a* releases the accumulated elastic force. Accordingly, the sensor 70 thus detects that the second rail 26 is moved away from the first predetermined position X1 relative to the first rail 24. In addition, when the driving member 62 returns to the first state S1 (as shown in FIG. 3 or FIG. 4) from the second state 52 (as shown in FIG. 6 or FIG. 5) along another direction (such as a counterclockwise direction), the locking member 52 is configured to be moved from the second position P2 to the first position P1 in response to the elastic force of the elastic member 58.

Figure 7:
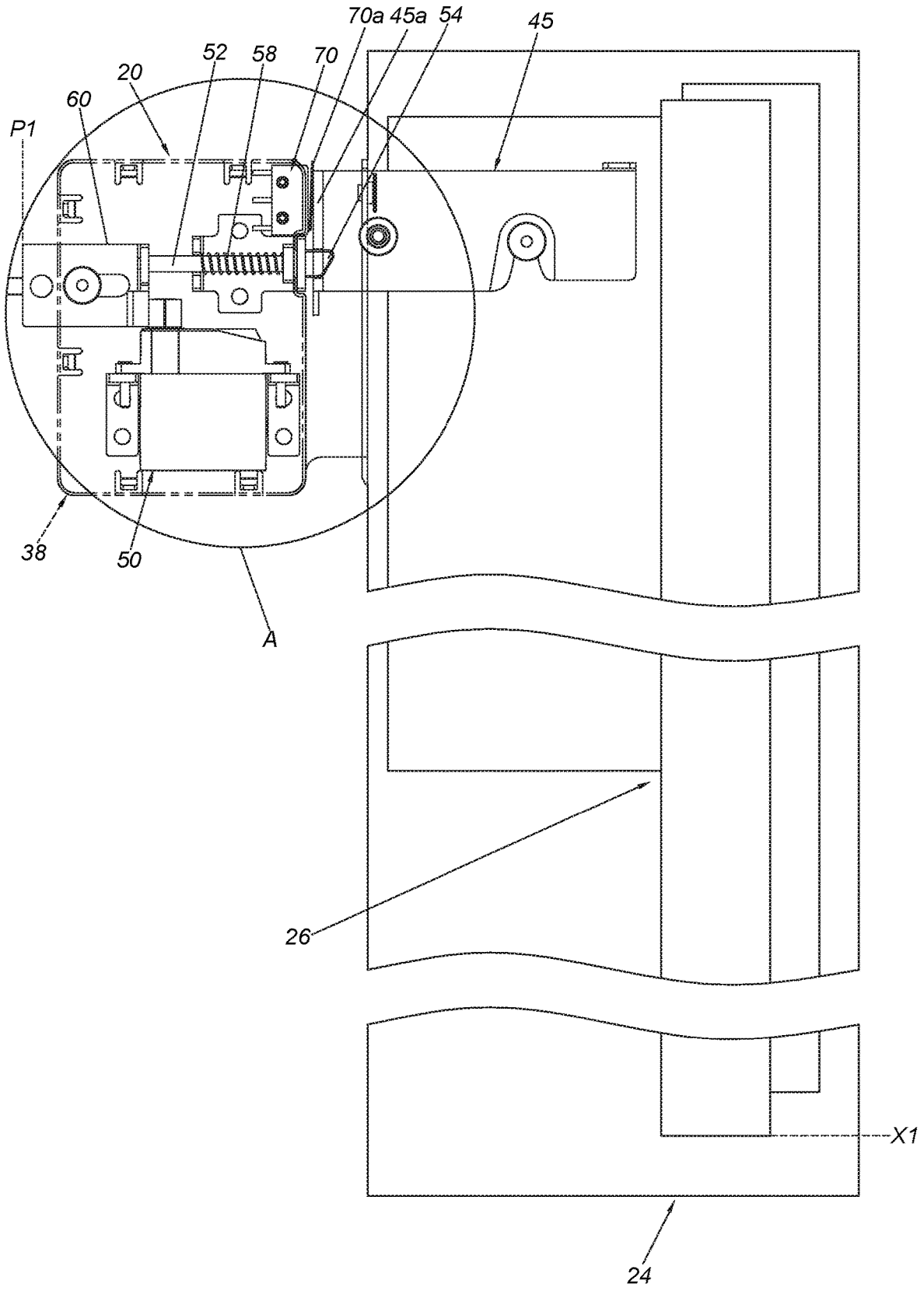
FIG. 7 is a top view of the lock mechanism configured to lock the second rail of the slide rail assembly in order to hold the second rail at the first predetermined position relative to the first rail according to the first embodiment of the present invention.
Figure 8:
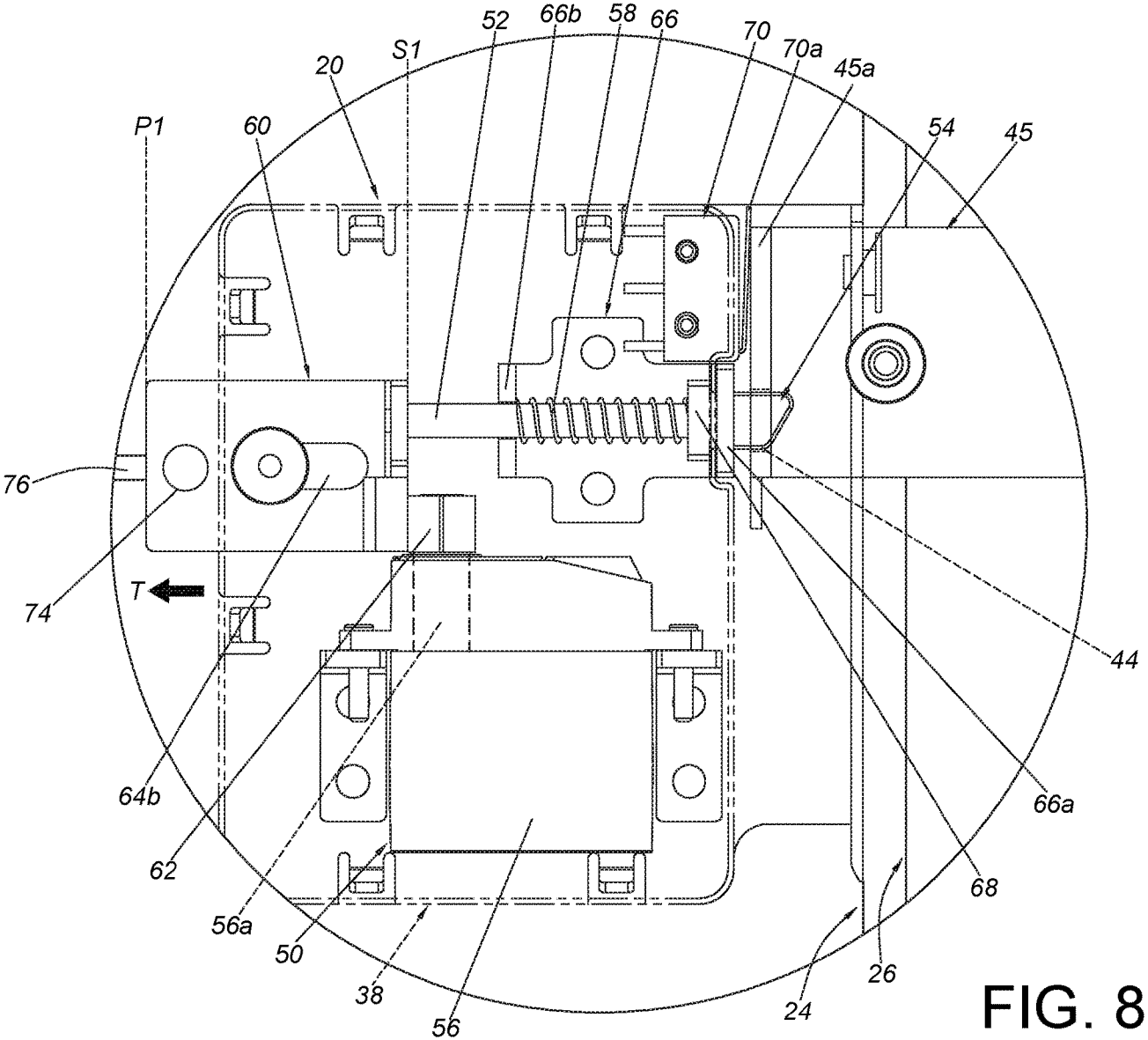
FIG. 8 is an enlarged view of an area A of FIG. 7.

As shown in FIG. 7 and FIG. 8, when the second rail 26 is located at the first predetermined position X1 relative to the first, rail 24 and the locking member 52 is located at the first position P1, the locking part 54 of the locking member 52 is configured to lock the additional feature 44 of the fitting member 45 of the second rail 26. In addition, when the second rail 26 is located at the first predetermined position X1, the extension wall 45*a* of the fitting member 45 of the second rail 26 is configured to press the elastic sensing part 70*a*, such that the sensor 70 can accordingly detect that the second rail 26 is located at the first predetermined position X1 relative to the first rail 24.

Figure 9:
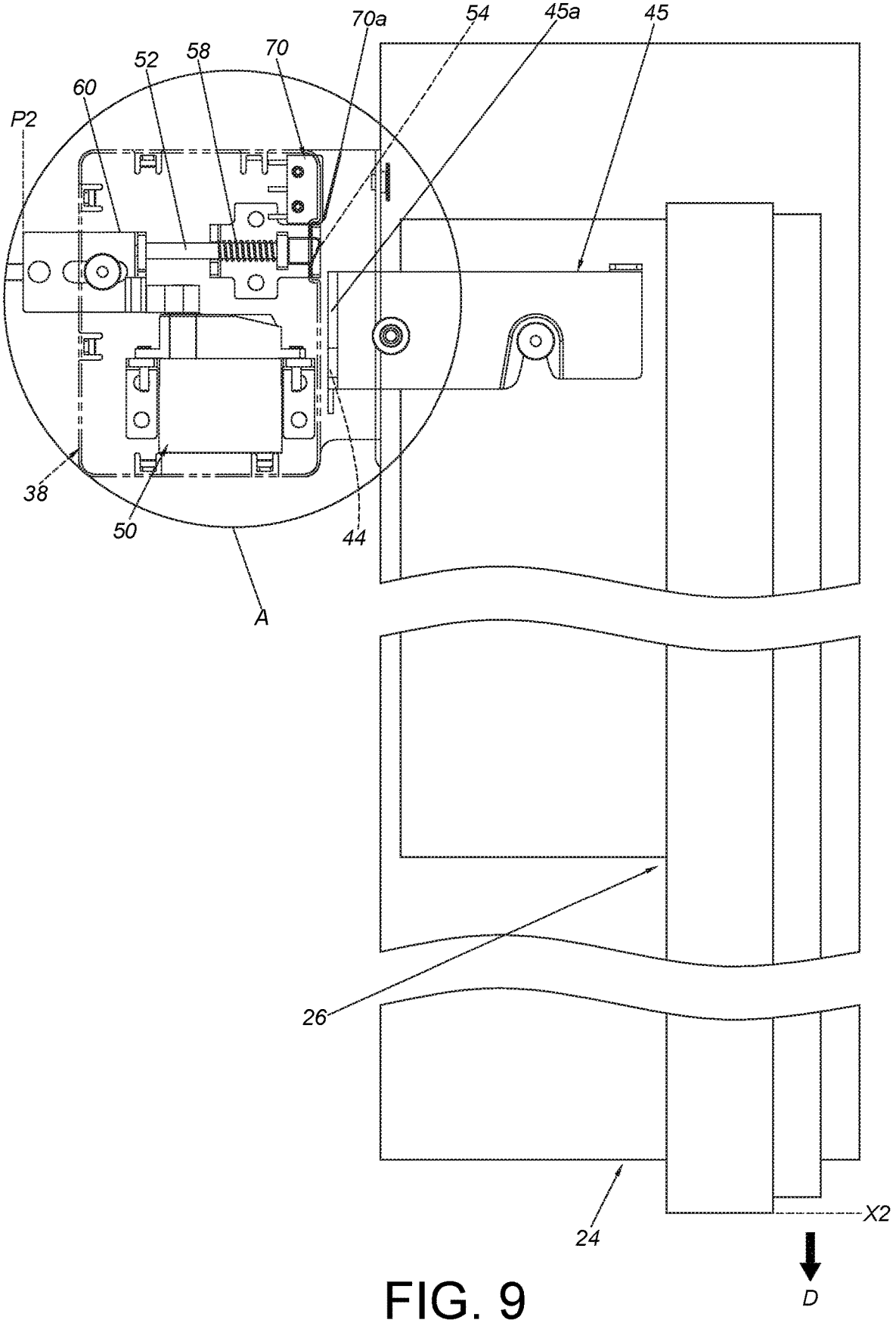
FIG. 9 is a top view of the lock mechanism no longer locking the second rail of the slide rail assembly for allowing the second rail to move relative to the first rail from the first predetermined position to a second predetermined position according to the first embodiment of the present invention.
Figure 10:
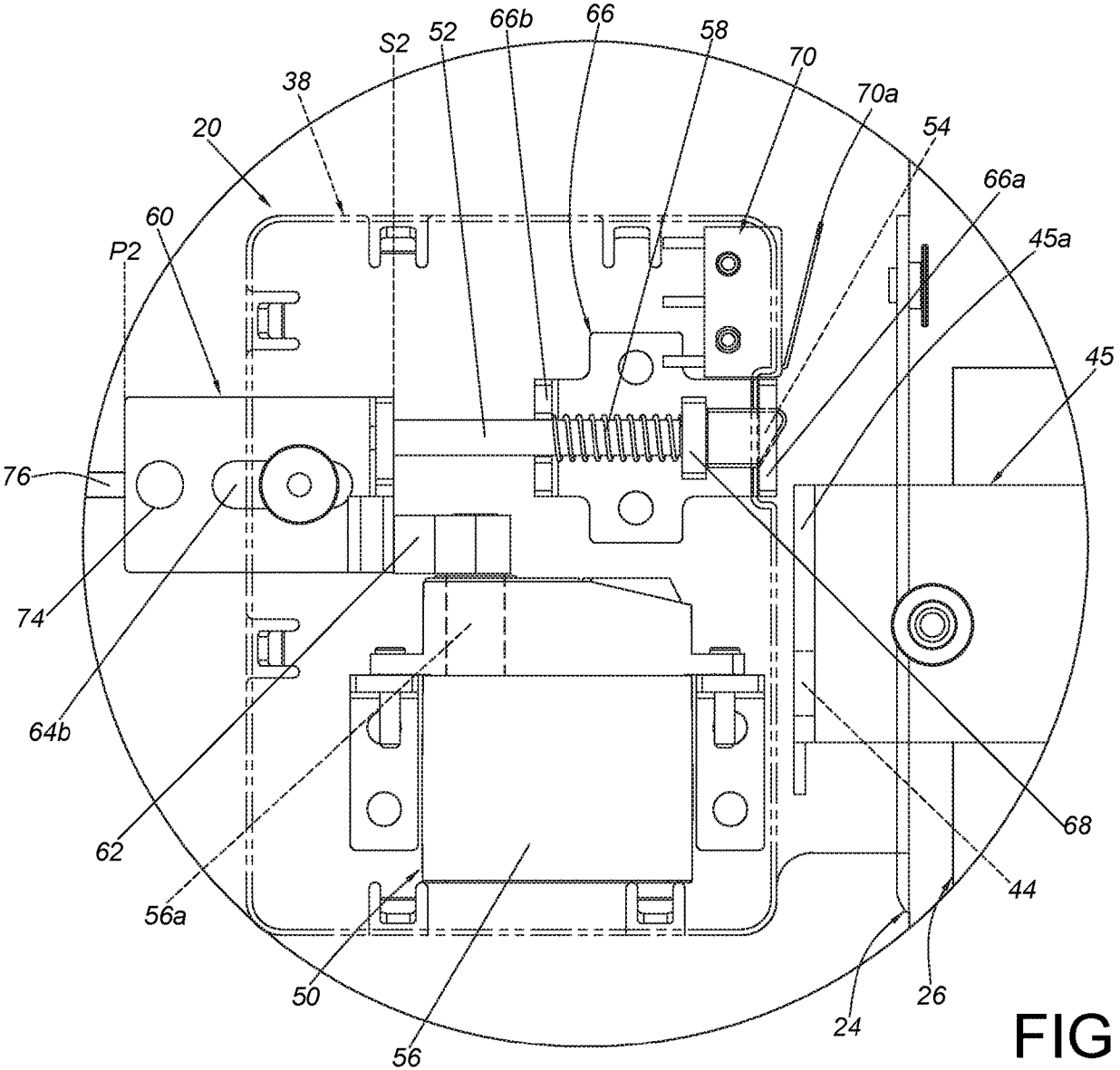
FIG. 10 is an enlarged view of an area. A of FIG. 9.

As shown in FIG. 8, FIG. 9 and FIG. 10, when the locking member 52 is driven by the driving device 50 to linearly move from the first position P1 to the second position P2 along the transverse direction T, the locking part 54 of the locking member 52 does not lock the additional feature 44 of the fitting member 45 of the second rail 26, such that the second rail 26 can be moved relative to the first rail 24 from the first predetermined position X1 to the second predetermined position X2 along the direction D. In addition, when the second rail 26 is no longer located at the first predetermined position X1 (such as being located at the second predetermined position X2), the extension wall 45*a* of the fitting member 45 of the second rail 26 no longer presses the elastic sensing part 70*a*, such that the sensor 70 can accordingly detect that the second rail 26 is moved away from the first predetermined position X1 relative to the first rail 24.

Figure 11:
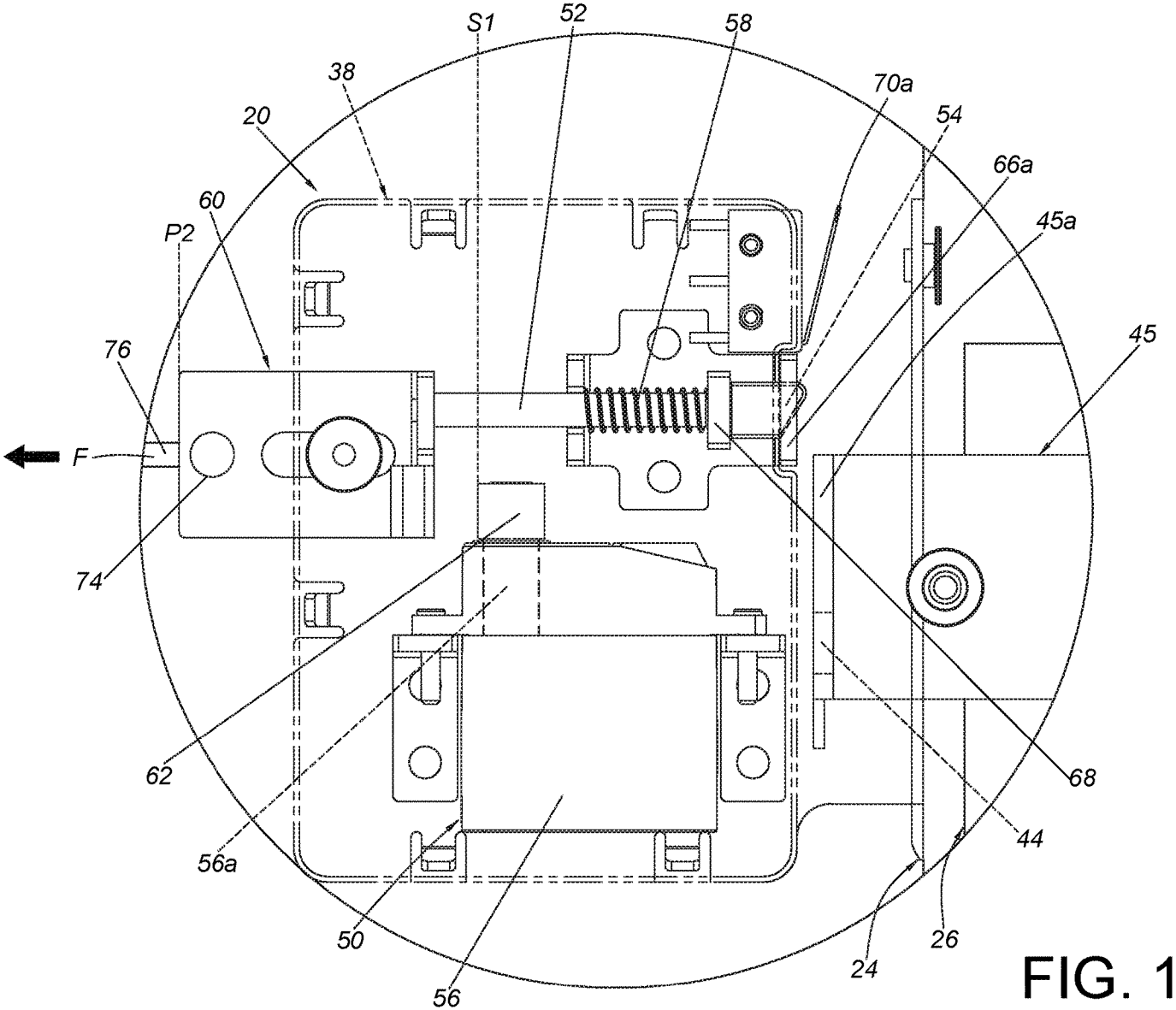
FIG. 11 is a diagram showing the lock mechanism configured to be manually operated according to the first embodiment of the present invention.

As shown in FIG. 8 and FIG. 11, the lock mechanism 20 further comprises a manual releasing feature 74 arranged on one of the linkage member 60 and the locking member 52. When the linkage member 60 does not move in response to the rotational driving force of the shaft 56*a* of the motor 56, a force F can be applied to the manual releasing feature 74, such that the manual releasing feature 74 can drive the locking member 52 to move from the first position P1 (as shown in FIG. 8) to the second position P2 (as shown in FIG. 11).

Furthermore, in the present embodiment, the manual releasing feature 74 is arranged on the linkage member 60, and the manual releasing feature 74 is a protrusion. A user can tie a string 76 onto the manual releasing feature 74 in advance. In some situation (such as in a situation of the motor 56 of the driving device 50 being out of power or damaged), the shaft 56*a* of the motor 56 of the driving device 50 is unable to operate, such that the driving member 62 in the first state S1 (as shown in FIG. 8) cannot drive the linkage member 60 to move. In such state, the user can apply the force F to the linkage member 60 through the string 76, so as to drive the locking member 52 to move from the first position P1 (as shown in FIG. 8) to the second position P2 (as shown in FIG. 11).

Figure 12:
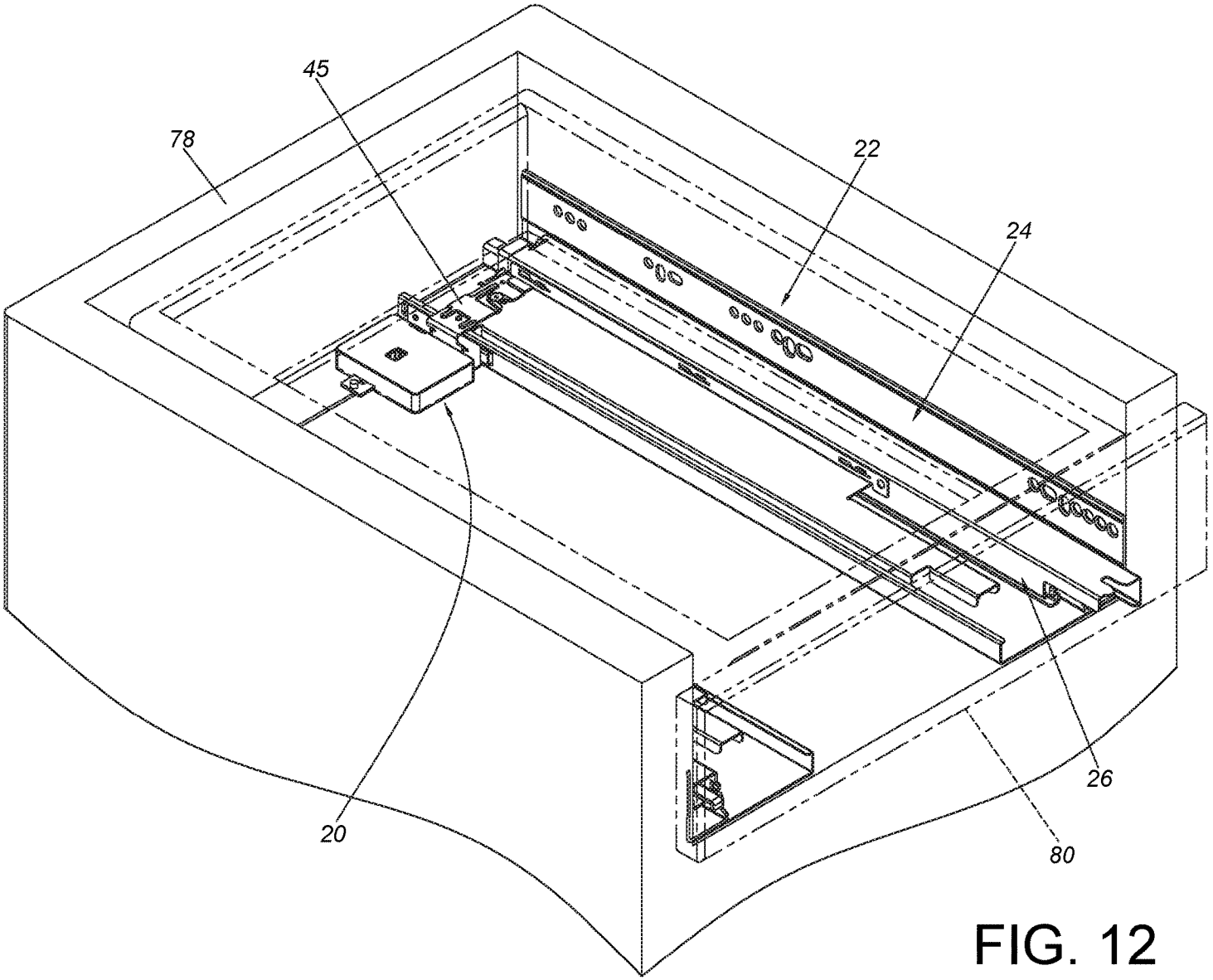
FIG. 12 is a diagram showing the slide rail assembly arranged with the lock mechanism applicable to a cabinet and a drawer of a furniture system according to the first embodiment of the present invention.

As shown in FIG. 12, the slide rail assembly 22 is an undermount drawer slide applicable to a furniture system. The furniture system comprises a cabinet 78 and a drawer 80. Most part of the slide rail assembly 22 is hidden under a bottom part of the drawer 80. Wherein, the first rail 24 is fixedly mounted to the cabinet 78, and the second rail 26 is configured to carry the bottom part of the drawer 80. Wherein, since configuration of the lock mechanism 20 has been disclosed in the aforementioned embodiment, no further illustration is provided for simplicity.

Figure 13:
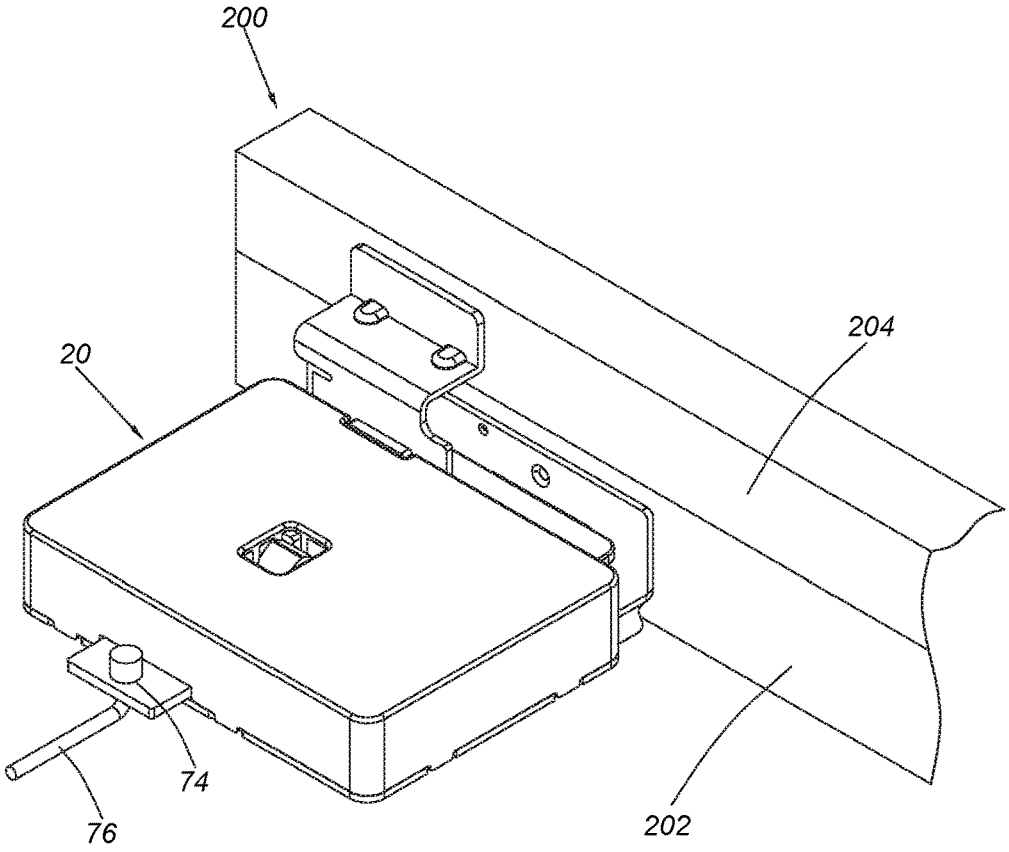
FIG. 13 is a diagram showing the lock mechanism applicable to another type of slide rail assembly with one of rails of the slide rail assembly being held at a predetermined position relative to the other one of the rails through locking of the lock mechanism according to a second embodiment of the present invention.
Figure 14:
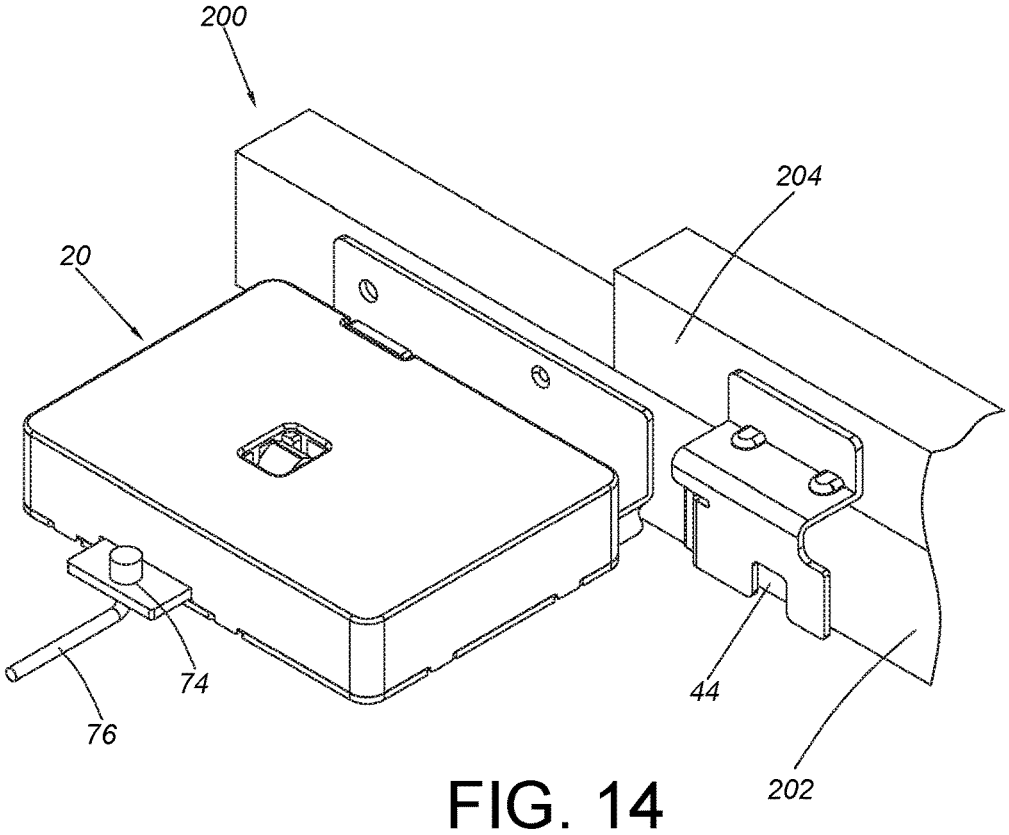
FIG. 14 is a diagram showing the lock mechanism applicable to another type of slide rail assembly with the lock mechanism no longer locking the rail to allow the rail to be located at another predetermined position relative to the other rail according to the second embodiment of the present invention.

As shown in FIG. 13 and FIG. 14, different from the slide rail assembly 22 of the first embodiment (undermount drawer slide), a slide rail assembly 200 of a second embodiment is a side-mounted slide. The slide rail assembly 200 comprises a first rail 202 and a second rail 204 movable relative to each other. Preferably, slide assisting members (such as balls not shown in figures) can be arranged between the first rail 202 and the second rail 204 for assisting relative movement of the first rail 202 and the second rail 204. Wherein, the first rail 202 can be fixed to a cabinet, and at least one portion of the second rail 204 can be mounted to a movable member, such as being mounted to a lateral side of a drawer. Moreover, the lock mechanism 20 can be mounted to one of the first rail 202 and the second rail 204, and the other one of the first rail 202 and the second rail 204 can be arranged with the additional feature 44. Wherein, configurations of the lock mechanism 20 and the additional feature 44, and interaction between the lock mechanism 20 and the additional feature 44 have been disclosed in the first embedment, thus no further illustration is provided for simplicity.

Figure 15:
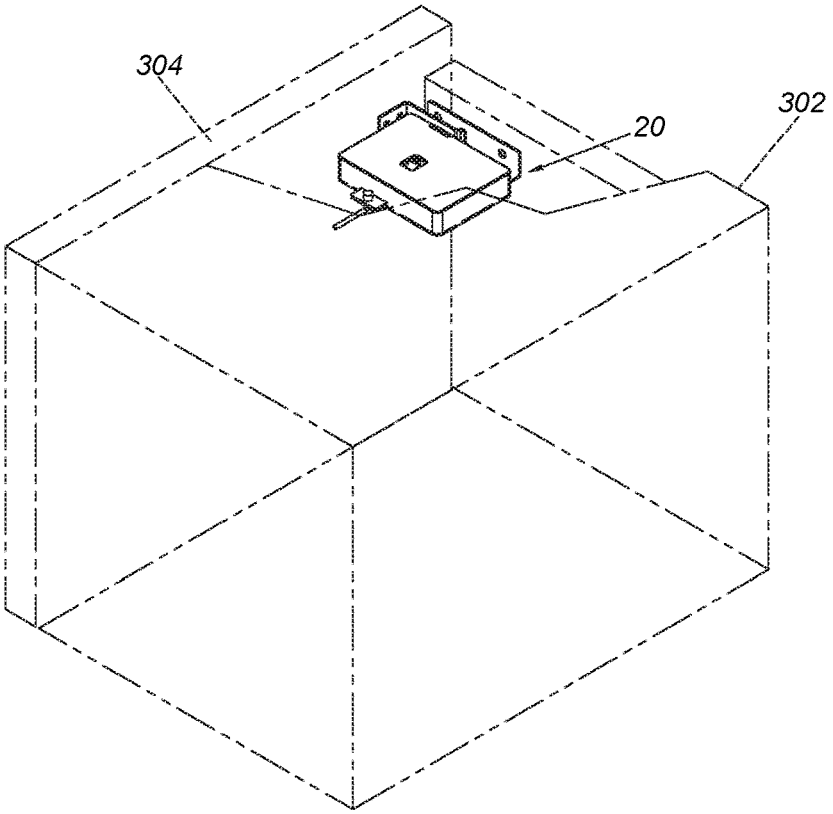
FIG. 15 is a diagram showing a lock mechanism applicable to a cabinet and a movable member, wherein the lock mechanism is configured to lock the movable member at a predetermined position relative to the cabinet according to a third embodiment of the present invention.
Figure 16:
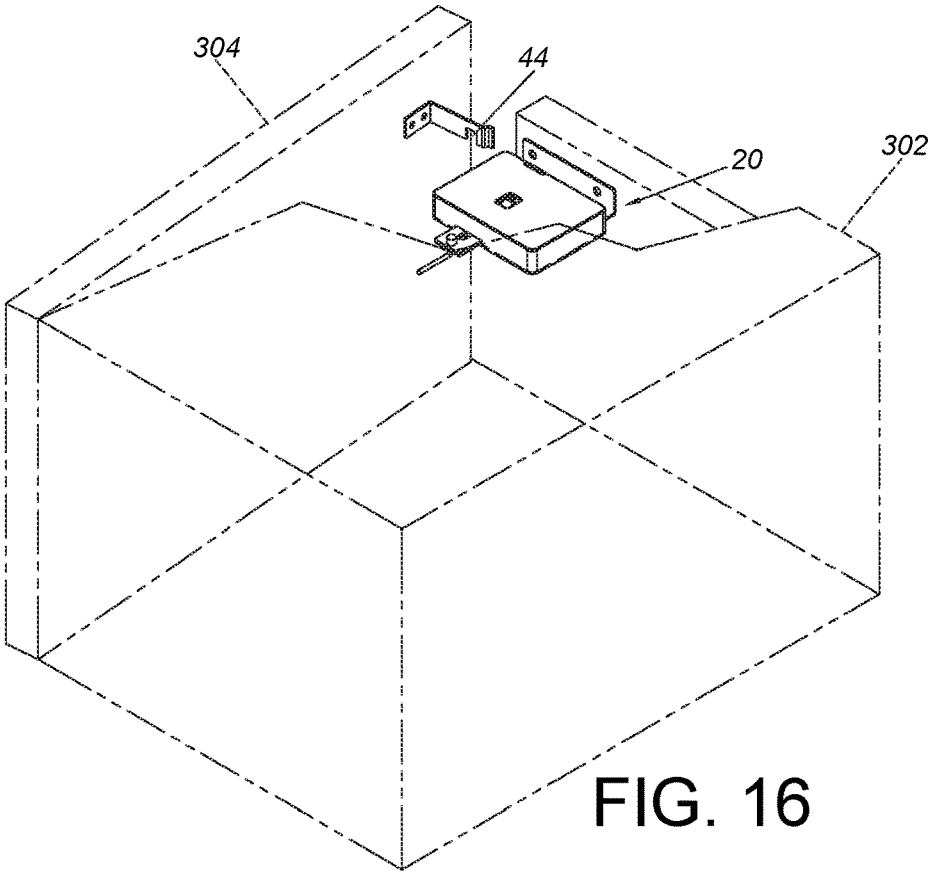
FIG. 16 is a diagram showing the lock mechanism unlocking the movable member for allowing the movable member to move away from the predetermined position relative to the cabinet according to the third embodiment of the present invention.

As shown in FIG. 15 and FIG. 16, in a third embodiment, the lock mechanism 20 is applicable to a first object and a second object movable relative to each other. In the present embodiment, the first object and the second object are respectively a cabinet 302 and a movable member 304. The movable member 304 is movable relative to the cabinet 302. The movable member 304, such as a door panel, is configured to be closed or opened relative to the cabinet 302. Moreover, the lock mechanism 20 can be mounted to one of the cabinet 302 and the movable member 304, and the other one of the cabinet 302 and the movable member 304 can be arranged with the additional feature 44. Wherein, configurations of the lock mechanism 20 and the additional feature 4 4, and interaction between the lock mechanism 20 and the additional feature 4 4 have been disclosed in the first embedment, thus no further illustration is provided for simplicity.

Therefore, the lock mechanism of the present invention is characterized in that:

1. The locking member 52 of the lock mechanism 20 is configured to be driven by the driving device 50 to move from the first position P1 to the second position P2 in a non-rotatable manner (such as in a linear manner).

2. The lock mechanism 20 is an electronic lock or a smart lock, and applicable to the first object and the second object movable relative to each other. The lock mechanism 20 is configured to lock the second object at the first predetermined position X1 relative to the first object, and the user can unlock the second object through an electronic control way. Wherein, a combination of the first object and the second object can be a combination of the first rail and the second rail, a combination of the cabinet and the drawer, or a combination of the cabinet and the door panel.

3. The lock mechanism 20 can be electrically controlled or manually operated to unlock the second object relative to the first object.

4. The sensor 70 is configured to detect whether the second object is located at the first predetermined position X1 relative to the first object.

5. The locking member 52 is configured to be held at the first position P1 in response to the elastic force of the elastic member 58.

6. The linkage member 60 is connected to the locking member 52, and the linkage member 60 and the base 38*a* of the housing 38 have corresponding structural features interacting with each other for guiding the linkage member 60 to linearly move relative to the housing 38.

7. The lock mechanism 20 is detachably connected to one of the first object and the second object. Therefore, the user can decide to mount the lock mechanism 20 to one of the first object and the second object according to requirements, and the other one of the first object and the second object is arranged with the additional feature 44 configured to interact with the lock mechanism 20.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A slide rail system, comprising:

a slide rail assembly having a first rail and a second rail movable relative to each other along a longitudinal direction of the first rail and the second rail;

a lock mechanism mounted on the first rail or the second rail, the lock mechanism comprising:

a driving device comprising a motor;

a driving member connected to a shaft of the motor;

a linkage member configured to be driven by the driving member to be linearly moved in response to a rotational driving force of the motor; and a locking member fixed to the linkage member in a non-rotatable manner and configured to be driven by the motor of the driving device through the linkage member to linearly move between a first position and a second position in a non-rotatable manner along a direction substantially perpendicular to the longitudinal direction of the first rail and the second rail, wherein the linkage member and the locking member can be seen as one piece; and a fitting member detachably connected to the other one of the first rail and the second rail, wherein an additional feature is provided on an extension wall of the fitting member to interact with a locking part of the locking member;

wherein when the locking member is located at the first position, the locking member is configured to interact with the additional feature to lock the other one of the first rail or the second rail;

wherein when the locking member is located at the second position, the locking member does not lock the other one of the first rail or the second rail;

wherein a linear moving direction of the linkage member is substantially perpendicular to a rotation axis of the shaft of the motor;

wherein the lock mechanism further comprises a housing, wherein the linkage member and the housing have corresponding structural features including a protrusion and an elongated hole interacting with each other for guiding the linkage member to linearly move relative to the housing within a limited range defined by the corresponding structural features.

2. The slide rail system of claim 1, wherein the lock mechanism further comprises an elastic member configured to provide an elastic force to the locking member.

3. The slide rail system of claim 2, wherein the lock mechanism further comprises a fixing base, wherein the locking member comprises a contact part, and the elastic member is arranged between the fixing base and the contact part.

4. The slide rail system of claim 1, wherein the lock mechanism further comprises a manual releasing feature arranged on the linkage member or the locking member, wherein when the linkage member does not move in response to the rotational driving force of the motor, the manual releasing feature is configured to drive the locking member to move from the first position to the second position.

5. The slide rail system of claim 1, wherein the lock mechanism is detachably connected to the first rail or the second rail through the housing.

6. The slide rail system of claim 1, wherein the lock mechanism further comprises a sensor configured to detect whether the second rail is located at a predetermined position relative to the first rail.

* * * * *